US006475370B2

(12) United States Patent
Lehmann et al.

(10) Patent No.: US 6,475,370 B2
(45) Date of Patent: Nov. 5, 2002

(54) PROCESS FOR THE PRODUCTION OF 2-HYDROXY-4-METHYLMERCAPTOBUTYRIC ACID

(75) Inventors: Thomas Lehmann, Langenselbold (DE); Rolf Schneider, Gründau (DE); Christoph Weckbecker, Gründau-Lieblos (DE); Elisabeth Dunach, Villeneuve Loubet (FR); Sandra Olivero, Nice (FR)

(73) Assignee: Degussa AG, Düsseldorf (DE)

( * ) Notice: Subject to any disclaimer, the term of this patent is extended or adjusted under 35 U.S.C. 154(b) by 0 days.

(21) Appl. No.: 09/931,165

(22) Filed: Aug. 17, 2001

(65) Prior Publication Data

US 2002/0053521 A1 May 9, 2002

(30) Foreign Application Priority Data

Aug. 18, 2000 (DE) ..... 100 40 402

(51) Int. Cl.[7] ..... C25B 3/00
(52) U.S. Cl. ..... 205/443; 205/445
(58) Field of Search ..... 205/443, 445

(56) References Cited

U.S. PATENT DOCUMENTS 4,782,173 A 11/1988 Burrington et al. ..... 558/255

OTHER PUBLICATIONS

Slah Mcharek, et al., "Electrocarboxylation de composes carbonyles aliphatiques, aromatiques et vinyliques: intérêt de l'utilsation d'une anode consommable en magnéisum," Bulletin De La Societe Chimique De France, 1989, pp. 95–97. Month Unavailable.

Copy of International Search Report in counterpart appln. No. PCT/EP 01/08357, dated Dec. 13, 2001.

*Primary Examiner*—Edna Wong
(74) *Attorney, Agent, or Firm*—Smith, Gambrell & Russell, LLP

(57) ABSTRACT

A process for the production of 2-hydroxy-4-methylmercaptobutyric acid (MHA) by electrochemical carboxylation of 3-methylmercapto-propionaldehyde in an undivided electrolytic cell containing a sacrificial anode, in an aprotic solvent in the presence of a supporting electrolyte. Preferred anode/cathode combinations are Mg/Mg and Mg/carbon. MHA is obtainable in a high yield.

23 Claims, 1 Drawing Sheet

PROCESS FOR THE PRODUCTION OF 2-HYDROXY-4-METHYLMERCAPTOBUTYRIC ACID

INTRODUCTION AND BACKGROUND

The present invention relates to a process for the production of 2-hydroxy-4-methylmercaptobutyric acid, referred to below as methionine hydroxy analog or MHA for short, from 3-methylmercaptopropionaldehyde.

2-Hydroxy-4-methylmercaptobutyric acid is used as a feed additive in a similar way to methionine and, owing to the structural similarity, it is therefore known as methionine hydroxy (MHA) analog.

Up to the present, MHA has conventionally been obtained from 3-methylmercaptopropionaldehyde, which, in turn, is obtainable by addition of methyl mercaptan to acrolein, by reaction with hydrogen cyanide and subsequent hydrolysis of the 4-methylmercapto-2-hydroxybutyronitrile formed. The need to use hydrogen cyanide is a disadvantage of this process. Owing to the high toxicity of hydrogen cyanide, costs relating to safety must be high for the reaction. Another very great disadvantage is the ammonium salt formed by the introduction of nitrogen and its subsequent hydrolytic cleavage, which is formed stoichiometrically and causes correspondingly high pollution of waste water. There is therefore a need for an HCN-free process for the production of MHA.

Accordingly, an object of the present invention is to provide a novel process for the production of MHA, in which, on the one hand, methylmercaptopropionaldehyde is used as a starting component and, on the other hand, instead of HCN another $C_1$ building block is to be reacted with methylmercaptopropionaldehyde (MMP).

It is known (EP-A 0 189 120 and G. Silvestri et al., Tetrahedron Letters 1986, 27, 3429–3430) to react carbon dioxide as a $C_1$ building block electrochemically with ketones and aldehydes, with α-hydroxycarboxylic acids being formed. While the electrochemical carboxylation of aromatic ketones generally leads to average to good yields, only moderate yields are achieved in the electrochemical carboxylation of aromatic aldehydes and in the carboxylation of aliphatic aldehydes, indeed, only low yields are achieved. In the process of the documents evaluated above, the electrocarboxylation takes place in an undivided electrolytic cell, which contains a sacrificial anode, in an aprotic solvent, which additionally contains a supporting electrolyte. The low yields and low selectivities of the electrochemical carboxylation of aldehydes, and especially aliphatic aldehydes, that have become known up to the present have, until now, prevented a person skilled in the art from seriously considering this method for an industrial process, such as the electrocarboxylation of 3-methylmercaptopropionaldehyde with $CO_2$.

SUMMARY OF THE INVENTION

Against all expectations, it has now been found that MMP can be carboxylated electrochemically in a high yield. The present invention accordingly provides a process for the production of 2-hydroxy-4-methylmercaptobutyric acid (MHA), which is characterized in that 3-methylmercaptopropionaldehyde (MMP) is electrochemically carboxylated with carbon dioxide in an undivided electrolytic cell containing a sacrificial anode in an aprotic solvent in the presence of a supporting electrolyte at an effective cell voltage and MHA is obtained from the MHA salt formed, which is dissolved and/or suspended in the electrolyte and the cation of which comes from the anode.

The process according to the invention is carried out in a simple electrolytic cell, which has only a single electrolyte chamber, as understood by the term "undivided".

BRIEF DESCRIPTION OF THE DRAWINGS

The present invention will be further understood with reference to the accompanying drawing which shows a schematic diagram of an electrolytic cell for carrying out the process according to the invention.

DETAILED DESCRIPTION OF THE INVENTION

Figure 1:
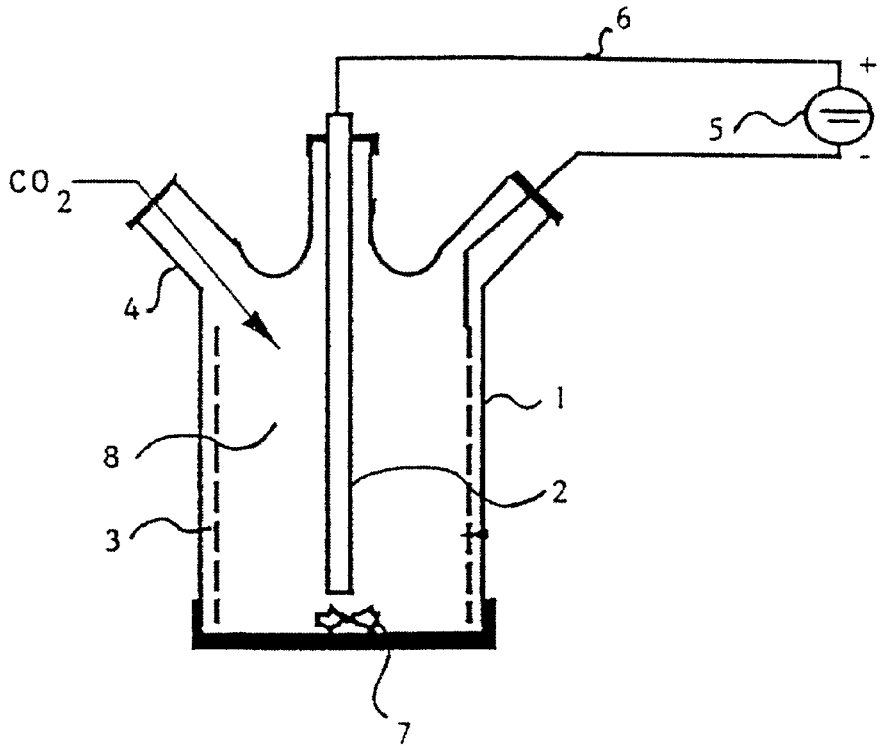

In the drawing electrolytic cell 1 comprises a centrally arranged sacrificial anode 2 and a cathode 3 arranged at a distance. The electrolytic cell contains a pipe connection 4 for the introduction of carbon dioxide and, if necessary, a device 7 for stirring the electrolyte 8. Anode and cathode are connected together through a supply point 5 via the current conductors 6.

In the electrocarboxylation of MMP with $CO_2$ according to the invention, a metal that is soluble under electrolysis conditions is used as the anode. Anode materials are, in particular, aluminum, magnesium, zinc, copper and alloys containing one or more of these metals. Although magnesium was mentioned as an anode material in the process according to EP-A 0 189 120, at the same time its use was not advised, because of electropassivation phenomena which occur after a brief current flow. Surprisingly, it has been found that, contrary to this teaching, magnesium displays particularly high efficacy as an electrode material in the electrocarboxylation of MMP and leads to substantially higher yields than the use of an aluminum anode.

Conventional good conductors are suitable as the cathode. Various conductive carbon materials, such as in particular graphite and carbon fiber non-wovens, are highly suited, as are nickel and especially magnesium. According to particularly preferred embodiments, the anode/cathode combination is Mg/Mg and Mg/carbon, such as in particular non-woven graphite.

The electrochemical carboxylation takes place in an aprotic solvent in the presence of a supporting electrolyte. Suitable solvents are liquid amides, nitriles and open-chain and cyclic ethers. N,N-Dimethylformamide is particularly preferred.

Alkali and alkaline earth halides, ammonium halides, but preferably alkyl, cycloalkyl or aryl ammonium salts, particularly quaternary ammonium salts, are suitable as supporting electrolytes, it being possible for the residues bonded to the nitrogen to be the same or different and aliphatic, cycloaliphatic or aromatic in nature. The anions of the quaternary ammonium salts are particularly chloride, bromide, iodide, tetrafluoroborate, hexafluorophosphate, para-toluenesulfonate, perchlorate and bis (trifluoromethylsulfonimide). Particularly suitable supporting electrolytes are tetra($C_1$ to $C_4$) alkylammonium tetrafluoroborate or hexafluorophosphate.

The formula diagram shows the products formed during the electrolysis of MMP in the presence of $CO_2$:

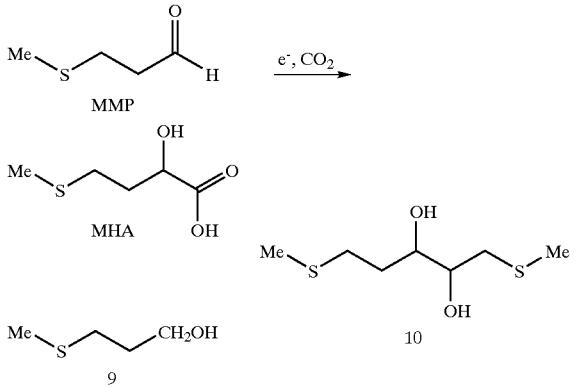

9 = 3-methylmercaptopropanol (MMPol)
10 = 1,6-bis(methylmercapto)-3,4-hexanediol (pinacol derivative, PD)

The following reactions take place during the electrochemical carboxylation of MMP:

at the anode: $2\ M \rightarrow 2\ M^{n\oplus} + 2\ n\ e^-$, wherein M signifies the anode metal and n the valency;

at the cathode: $n\ RCHO + n\ CO_2 + 2\ n\ e^- \rightarrow n\ R{-}CH(O^-){-}CO_2^-$ in the solution: $2\ M^{n\oplus} + n\ R{-}CH(O^-){-}CO_2^- \rightarrow M_2\ (R{-}CH(O){-}CO_2)_n$ wherein R denotes $CH_3{-}S{-}CH_2{-}CH_2{-}$.

The formation of the complex salt prevents the formation of by-products to a fairly large extent. In particular, when magnesium is used as the anode material, the undesirable formation of pinacol is suppressed, so that the selectivity of the electrochemical carboxylation of MMP is very high. At the same time, when a magnesium anode is used, product yields in the range of around/over 80% are obtainable even without optimizing the process.

To carry out the process according to the invention, MMP is dissolved in the solvent containing a supporting electrolyte and then an effective voltage is applied to the anode and cathode. A voltage in the range of about 3 to 30 V, particularly about 10 to 30 V, has proved favorable; however, a higher or lower voltage is not ruled out. Although a potentiostatic operation is possible, a galvanostatic operation is preferred because it is better for implementation on an industrial scale. The electrolysis is therefore preferably performed galvanostatically with a current density in the range of 0.1 to 10 A/dm$^2$, particularly 0.2 to 2 A/dm$^2$.

The carboxylation is usefully carried out at a temperature in the range of 10° C. to 50° C., particularly 10° C. to 30° C. Carbon dioxide can either be introduced into the electrolytic cell with a partial pressure of less than 1 bar in a mixture with another gas, which can, at the same time, serve to improve thorough mixing, or alternatively carbon dioxide is passed through the electrolytic cell under normal pressure. According to another alternative, a $CO_2$ pressure in the range of 1 to 5 bar is maintained within the electrolytic vessel.

To obtain MHA from the MHA salt dissolved in the electrolyte, this is usefully precipitated out by adding a solvent having low polarity and filtered off. The salt is then treated with aqueous mineral acid by a method that is known per se and the MHA extracted from the aqueous phase by means of an organic solvent, generally having low polarity. The phase containing the aprotic solvent and the supporting electrolyte is recycled into the electrolysis step after separating off the solvent used to precipitate the MHA salt.

The process according to the invention can be performed in batches or continuously; when operated continuously, a flow-through electrolytic cell is used. The advantages of the process according to the invention lie in the fact that it is possible, using MMP but avoiding the use of hydrogen cyanide, to obtain MHA in a high yield and with good selectivity. In the best current embodiment using a magnesium anode and a magnesium or carbon cathode, tetra-n-butylammonium tetrafluoroborate as the supporting electrolyte and dimethylformamide as the solvent, the methionine hydroxy analog (MHA) is obtainable in a yield of 80% to 85% with a current efficiency of 45% to 60%.

Surprisingly, because contrary to the teaching of the prior art evaluated at the beginning, it has been found that, apart from MMP, other aldehydes, including in particular aliphatic aldehydes such as e.g. phenylpropionaldehyde, can be electrochemically carboxylated in the same way as in the claimed process for the production of MHA with, in some cases, high selectivity, if magnesium is used as the anode. An Mg/C anode/cathode combination is particularly preferred in this case. In addition to quaternary ammonium salts, KCl and KBr are also particularly suitable as the supporting electrolyte. The influence of different supporting electrolytes with the Mg/C electrode pairing in the electrochemical carboxylation of phenylpropionaldehyde to 4-phenyl-2-hydroxybutyric acid (PHBS) can be taken from table 1; the pinacol by-product is 1,6-diphenyl-3,4-dihydroxyhexane. The electrode pairing selected and the supporting electrolyte can also have a marked influence on the yield in the carboxylation of MMP.

TABLE 1

| Supporting electrolyte | Faraday yield (F/mol) | Conversion (%) | Yield PHBS (%) | Yield Pinacol (%) |
|---|---|---|---|---|
| $nBu_4N^+BF_4^-$ | 5.4 | 100 | 50 | 50 |
| $nBu_4N^+Br^-$ | 8.5 | 75 | 45 | 50 |
| KBr | 5 | 34 | 50 | 45 |
| KCl | 10 | 55 | 70 | 20 |

The following examples elucidate the invention and show the influence of various parameters on the yield, selectivity and current efficiency.

2-Hydroxy-4-methylmercaptobutyric acid (MHA) was produced by electrochemical carboxylation from 3-methylmercaptopropionaldehyde (MMP).

General Specification

The electrolyte is prepared by solutions of the supporting electrolyte (0.025 to 0.1 mol/l) in the electrolyte (N,N-dimethylformamide). Freshly distilled methylmercaptopropionaldehyde is metered in until the desired concentration is reached. Galvanostatic electrolysis is performed in an undivided electrolytic cell according to the drawing with a rod-shaped anode and a sheet-shaped cathode at room temperature. After a specific amount of charge has been consumed, the current is turned off and the solution worked up. For the analytical determination of the products, esterification is performed with methanol/$H_2SO_4$ in the electrolyte solution and a sample is fed into GC analysis. Another method consists in releasing the 2-hydroxy-4-methylmercaptobutyric acid from its salt by adding acid, and then determining analytically by HPLC.

EXAMPLE 1

200 $\mu$l freshly distilled methylthiopropionaldehyde (=2 mmol MMP) are added to a solution of 50 ml freshly distilled DMF (N,N-dimethylformamide) and 50 mg $(C_4H_9)_4N(BF_4)$ (tetrabutylammonium tetrafluoroborate), i.e. 0.15 mmol, as a supporting electrolyte. Electrolysis is performed in an undivided cell with an Mg sacrificial anode (Mg rod) A=20 $cm^2$ and Mg cathode under ~1 bara $CO_2$ pressure (atmospheric pressure) at room temperature.

The current applied is 120 mA, i.e. 0.6 $A/dm^2$. The cell voltage varies between 3 and 20 V. After an amount of charge of 960 C has flowed, i.e. 5 F/mol, the current is turned off and the solution worked up. For the analytical determination of the products, esterification is performed with $MeOH/H_2SO_4$ in the electrolyte solution and fed into GC analysis.

Result: After 90% conversion, MHA is obtained with a selectivity of 75% and with 25% the corresponding pinacol (PD). A reduction of MMP to methylmercaptopropanol (MMPol) was not observed here. To work up the reaction mixture, after acidifying with aqueous HCl the mixture is extracted with ether and, after evaporating off the latter, the free MHA is obtained.

EXAMPLES 2 TO 11

The reaction was varied in respect of various parameters. Table 2 shows the parameters and the results achieved.

The examples show that, with an Mg anode, a higher carboxylation yield can usually be achieved than with an Al anode.

Further variations and modifications of the foregoing will be apparent to those skilled in the art and are intended to be encompassed by the claims appended hereto.

German priority application DE 100 40 402.2 is relied on and incorporated herein by reference.

TABLE 2

| Example No. | 2 | 3 | 4 | 5 | 6 | 7 | 8 | 9 | 10 | 11 |
|---|---|---|---|---|---|---|---|---|---|---|
| Anode | Al | Mg | Mg | Mg | Mg | Al | Al | Mg | Mg | Mg |
| (area in $cm^2$) | 38 | 10 | 5 | 10 | 10 | 10 | 10 | 10 | 10 | 10 |
| Cathode | Ni | C | Mg | C | C | Mg | Mg | Mg | Mg | Mg |
| (area in $cm^2$) | 90 | 25 | 5 | 25 | 25 | 25 | 25 | 25 | 25 | 25 |
| Supporting | $nBu_4NI$ | $nBuNBF_4$ | $nBuNBF_4$ | $NbuNBF_4$ | $nBuNBF_4$ | $nBuNBF_4$ | $nBuNBF_4$ | $nBuNBF_4$ | $nBuNBF_4$ | $nBuNBF_4$ |
| electrolyte | 0.1 | 0.025 | 0.025 | 0.025 | 0.025 | 0.025 | 0.025 | 0.025 | 0.025 | 0.025 |
| (concentration in mol/1) | | | | | | | | | | |
| Solvent | CAN | ACN | DMF | DMF | DMF | DMF | DMF | DMF | DMF | DMF |
| MMP (concentration in mol/1) | 0.2 | 0.05 | 0.15 | *) 0.5 mmol/h | 0.05 | 0.05 | 0.05 | 0.05 | 0.05 | 0.05 |
| $CO_2$ pressure (bara) | 1.07 | 1 | 4 | 1 | 1 | 1 | 1 | 1 | 1 | 4 |
| Current density ($A/dm^2$) | 0.6 | 0.3 | 1.2 | 0.24 | 0.3 | 0.3 | 0.3 | 0.3 | 0.6 | 0.3 |
| MHA yield (%) | 19 | 30 | 85 | 80 | 50 | 30 | 50 | 65 | 75 | 85 |
| PD yield | | 70 | | | | 70 | | 35 | 25 | |
| MMPol yield | | | | | 50 | | 50 | | | |
| Current efficiency (%) | 41 | 30 | 52 | 45 | 20 | 20 | 43 | 40 | 40 | 60 |
| Conversion (%) | 80 | 90 | | | 100 | 85 | 83 | 80 | 90 | 92 |

*) Continuous addition of MMP (0.5 mmol/h)
ACN = acetonitrile; DMF = dimethylformamide
PD = pinacol derivative
MMPol = methylmercaptopropanol

We claim:

1. A process for the production of 2-hydroxy-4-methylmercaptobutyric acid (MHA), comprising reacting 3-methylmercaptopropionaldehyde (MMP) with carbon dioxide in an undivided electrolytic cell containing a sacrificial anode in an aprotic solvent in the presence of a supporting electrolyte at an effective cell voltage to thereby electrochemically carboxylate said MMP to form a MHA salt, and dissolving and/or suspending said salt in the electrolyte and the cation of which comes from the anode to obtain MHA.

2. The process according to claim 1, wherein electrochemical carboxylation of MMP is carried out in the electrolytic cell with an anode/cathode combination selected from the group consisting of Mg/Mg and Mg/carbon.

3. The process according to claim 2, wherein the electrochemical carboxylation of MMP is carried out in dimethylformamide as the solvent in the presence of the supporting electrolyte which is selected from the group consisting of tetraalkylammonium bromide, tetrafluoroborate and hexafluorophosphate, wherein the alkyl groups in the tetraalkylammonium cation can be the same or different and contain 1 to 4 C atoms.

4. The process according to claim 3, wherein the carboxylation is carried out under a $CO_2$ pressure in the range of 1 to 5 bar.

5. The process according to claim 3, wherein the carboxylation is carried out continuously using a flow-through electrolytic cell.

6. The process according to claim 2, wherein the carboxylation is carried out at a current density in the range of 0.1 $A/dm^2$ to 10 $A/dm^2$.

7. The process according to claim 2, wherein the carboxylation is carried out under a $CO_2$ pressure in the range of 1 to 5 bar.

8. The process according to claim 2, wherein the carboxylation is carried out continuously using a flow-through electrolytic cell.

9. The process according to claim 1, wherein the electrochemical carboxylation of MMP is carried out in dimethylformamide as the solvent in the presence of the supporting electrolyte which is selected from the group consisting of tetraalkylammonium bromide, tetrafluoroborate and hexafluorophosphate, wherein the alkyl groups in the tetraalkylammonium cation can be the same or different and contain 1 to 4 C atoms.

10. The process according to claim 9, wherein the carboxylation is carried out at a current density in the range of 0.1 $A/dm^2$ to 10 $A/dm^2$.

11. The process according to claim 9, wherein the carboxylation is carried out under a $CO_2$ pressure in the range of 1 to 5 bar.

12. The process according to claim 9, wherein the carboxylation is carried out continuously using a flow-through electrolytic cell.

13. The process according to claim 1, wherein the carboxylation is carried out at a current density in the range of 0.1 $A/dm^2$ to 10 $A/dm^2$.

14. The process according to claim 13, wherein the carboxylation is carried out continuously using a flow-through electrolytic cell.

15. The process according to claim 1, wherein the carboxylation is carried out under a $CO_2$ pressure in the range of 1 to 5 bar.

16. The process according to claim 1, wherein the carboxylation is carried out continuously using a flow-through electrolytic cell.

17. A process for the production of 2-hydroxy-4-methylmercaptobutyric acid (MHA), comprising dissolving 3-methylmercaptopropionaldehyde (MMP) in a solvent containing a supporting electrolyte, in an undivided electrolytic cell containing a sacrificial anode and a cathode, applying an effective voltage to said anode and cathode in the presence of said supporting eletrolyte, the voltage being effective to carry out the process, and introducing carbon dioxide into said cell at a sufficient pressure to electrochemically carboxylate said MMP to produce MHA salt, dissolving the MHA salt in the electrolyte and precipitating out the MHA salt and filtering to recover said MHA salt, treating said salt with a mineral acid and extracting MHA from the aqueous phase by an organic solvent.

18. The process according to claim 17, wherein the electrochemical carboxylation of MMP is carried out in the electrolytic cell with an anode/cathode combination from the series Mg/Mg or Mg/carbon.

19. The process according to claim 17 wherein the eletrolyte is N, N-dimethylformamide.

20. The process according to claim 17, wherein the electrochemical carboxylation of MMP is carried out in dimethylformamide as the solvent in the presence of the supporting electrolyte which is from the series tetraalkylammonium bromide, tetrafluroroborate or hexafluorophosphate, wherein the alkyl groups in the tetraalkylammonium cation can be the same or different and contain in particular 1 to 4 C atoms.

21. The process according to claim 17, wherein the carboxylation is carried out at a current density in the range of 0.1 $A/dm^2$ to 10 $A/dm^2$.

22. The process according to claim 17, wherein the carboxylation is carried out under a $CO_2$ pressure in the range of 1 to 5 bar.

23. The process according to claim 17, wherein the carboxylation is carried out continuously using a flow-through electrolytic cell.

* * * * *